United States Patent [19]

Eck

[11] 4,247,979

[45] Feb. 3, 1981

[54] RADIANT HEATER AND METHOD OF MAKING SAME

[76] Inventor: Richard H. Eck, 352 Pines Lake Dr. East, Wayne, N.J. 07470

[21] Appl. No.: 18,843

[22] Filed: Mar. 8, 1979

[51] Int. Cl.[3] ..... H05B 3/26

[52] U.S. Cl. ..... 29/611; 29/613; 219/345; 338/311

[58] Field of Search ..... 29/611, 612, 613, 619, 29/621; 219/345, 390, 544; 338/311

[56] References Cited

U.S. PATENT DOCUMENTS

| | | | |
|---|---|---|---|
| 2,179,934 | 11/1939 | Jones | 219/544 |
| 3,043,943 | 7/1962 | Moot | 219/345 |
| 3,047,702 | 7/1962 | Lefebvre | 219/476 |
| 3,095,491 | 6/1963 | Deacon | 219/345 |
| 3,143,637 | 8/1964 | Rifenbergh | 219/345 |
| 3,277,273 | 10/1966 | Williams | 219/213 |
| 3,303,324 | 2/1967 | Appleman | 219/213 |
| 3,479,490 | 2/1969 | Stark | 219/544 |
| 3,550,267 | 12/1970 | Williams | 29/611 |

*Primary Examiner*—Francis S. Husar
*Assistant Examiner*—Gene P. Crosby
*Attorney, Agent, or Firm*—Gottlieb, Rackman & Reisman

[57] ABSTRACT

There is disclosed a radiant heater having high efficiency, reduced cost, and longer life, and which allows rapid heat-up and cool-down. As in the prior art, a heating coil is placed in grooves formed in an insulating board; the radiating surface is a fiberglass cloth secured by adhesive to that face of the insulating board which contains the grooves and the wire coil. In making the heater of the invention, the cement is allowed to dry while the board and cloth are placed on a supporting surface with the cloth face down. The cement thus adheres primarily to that portion of the coil closest to the cloth. This manufacturing step results in a cement distribution which significantly affects both the cost, life and performance of the heater.

9 Claims, 8 Drawing Figures

FIG. 1
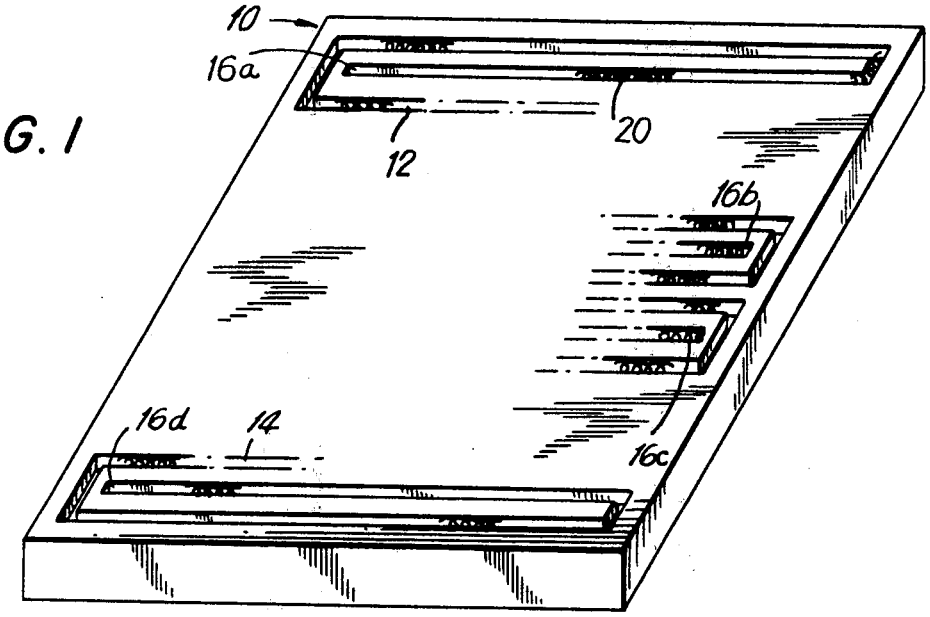
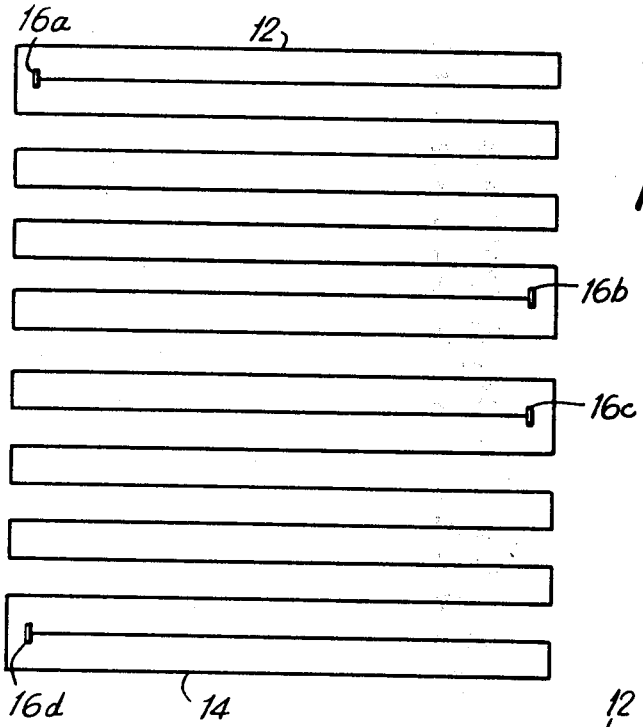
FIG. 1A
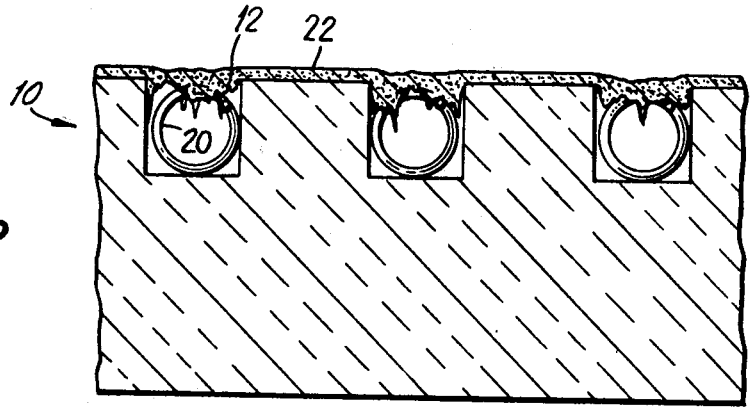
FIG. 2

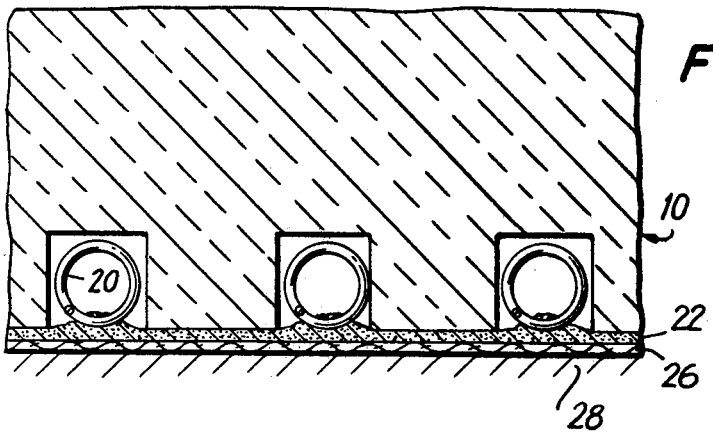
FIG. 3
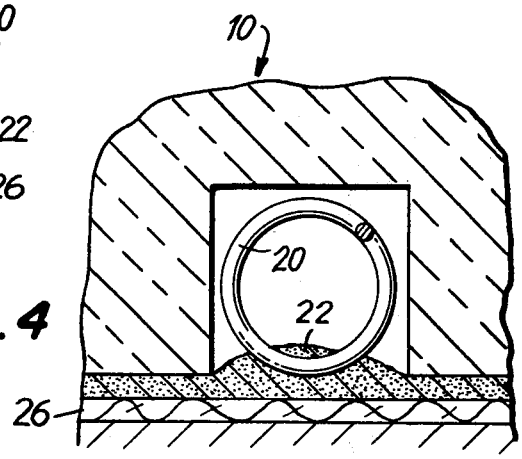
FIG. 4
FIG. 5
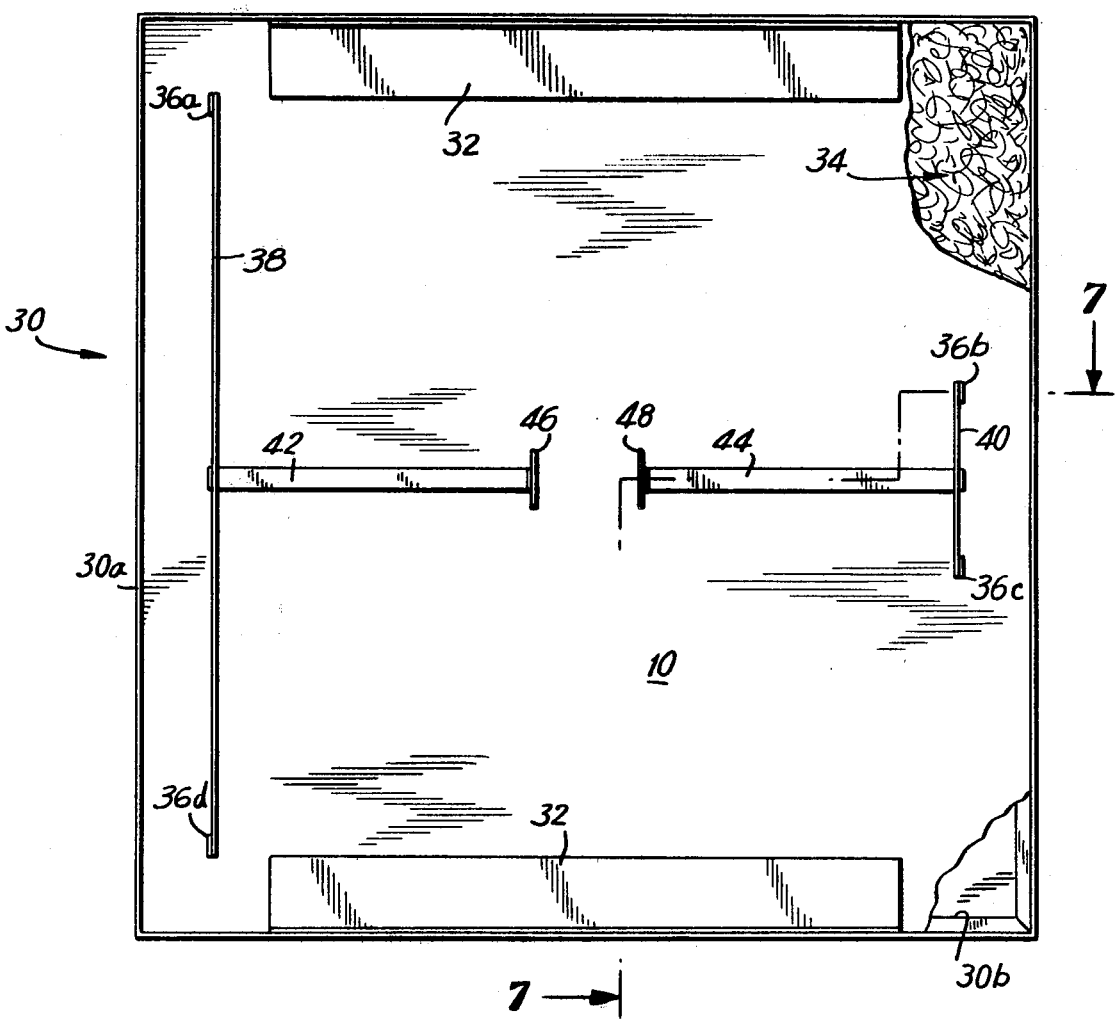

RADIANT HEATER AND METHOD OF MAKING SAME

This invention relates to radiant heaters, and more particularly to radiant heaters having high efficiency, low cost and long life, and which exhibit rapid heat-up and cool-down.

A standard construction for a radiant heater is that in which a wire heating coil is placed in a groove or grooves formed in the surface of an insulating board. A radiating surface such as a fiberglass cloth is placed over the board and secured thereto by cement. Current flowing through the coil causes it to heat up and to radiate heat from the cover cloth. This standard type of construction is shown, for example, in U.S. Pat. Nos. 3,047,702, 3,095,491, 3,277,273, 3,303,324 and 3,550,267.

Most of the advances in the art pertain to increasing the efficiency of a heater, extending its life, lowering its cost, and allowing for more rapid heat-up and cool-down. (Especially in industrial applications, rapid cool-down may be as important as rapid heat-up.) It is a general object of my invention to provide a heater which exhibits improvements in all of these areas.

Briefly, the principal feature of my invention relates to the manner in which the insulating board, wire coil and cover cloth are secured to each other. A layer of cement is employed as in the prior art, but the cement is allowed to dry by turning the panel assembly upside-down, with the cover cloth being face down. The coil is loosely fitted in the groove, and a thinned cement is utilized. When the panel assembly is turned upside-down, not only does the coil drop down away from the "bottom" of the groove toward the cloth, but the cement also flows downwardly. The coil thus makes minimum contact with the walls of the groove, and the cement adheres primarily to that portion of the coil which is closest to the cloth. (In general, at least 75% of the cement is on the front half of the coil.) As will be explained below, following this procedure contributes to all of the advantages of the invention.

Further objects, features and advantages of the invention will become apparent upon consideration of the following detailed description in conjunction with the drawing, in which:

FIG. 1 depicts the first step in the construction of the radiant heater of my invention, with a wire coil being placed in the groove of an insulating board;

FIG. 1A illustrates the groove/coil lay-out in full;

FIG. 2 is a partial sectional view showing the manner in which a layer of cement is applied to the front, grooved surface of the insulating board;

FIG. 3 is a partial sectional view showing the panel assembly of FIG. 2 having a cover cloth attached thereto, with the entire assembly being turned upside-down during the cement-drying step;

FIG. 4 is an enlarged view of a portion of FIG. 3 illustrating the cement distribution following drying;

FIG. 5 is a rear view depicting the insulating board mounted in the heater housing (without the rear cover), together with the electrical connections to the heater;

Figure 6:
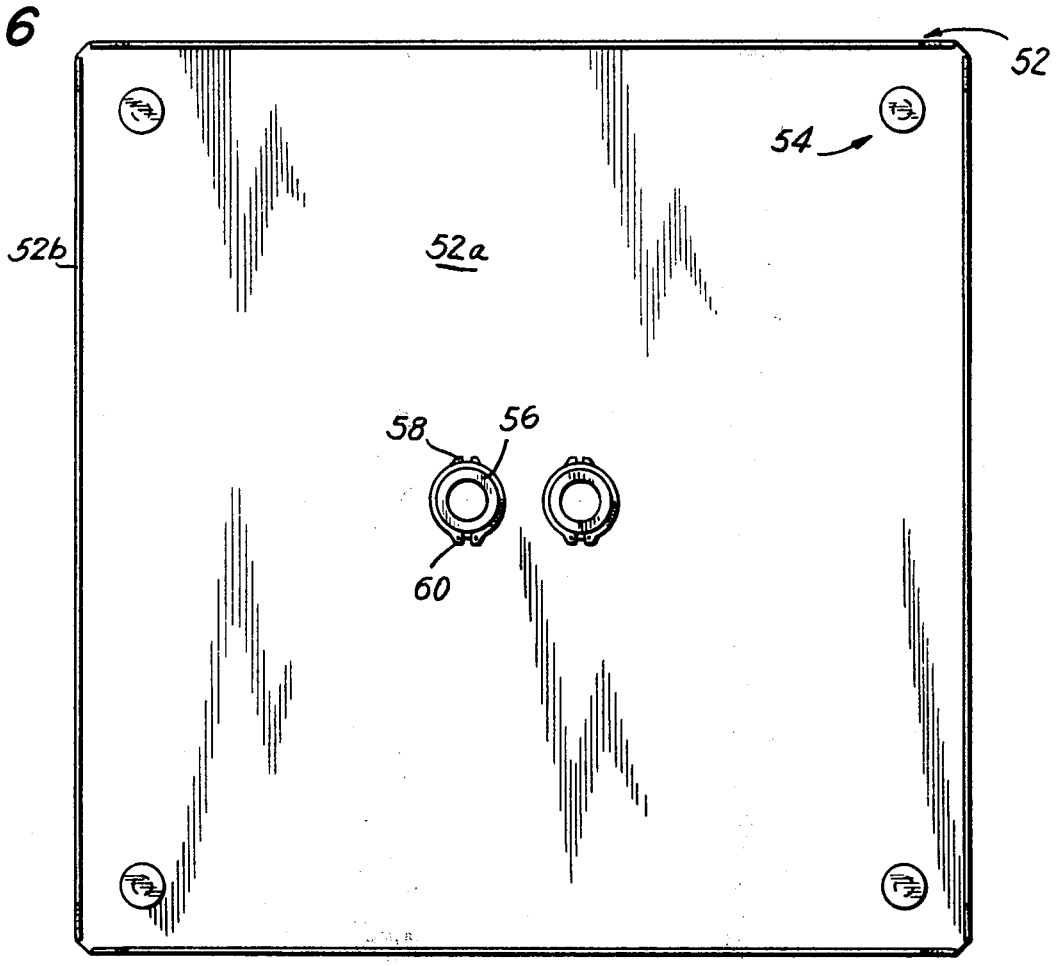
FIG. 6 shows the rear cover of the heater.

The first step in the manufacturing process is to machine a groove or grooves in one surface of insulating board 10. This prior art step is depicted in FIG. 1. In the illustrative embodiment of the invention, two grooves

12, 14 are formed, each for containing a section of the heating coil 20. At the four ends of the grooves, designated by the numerals 16*a*–16*d*, holes are drilled all the way through the insulating board. Four short wire strips 36*a*–36*d* (see FIG. 7) are passed through these holes and welded to the ends of the wire coils. These strips serve as the electrical terminal connections to the coils for conducting current. The particular groove pattern (as well as the number of grooves employed) can be varied, and a typical pattern is illustrated in FIG. 1A. (FIG. 1 does not depict the complete pattern, nor is it drawn to scale.) In the pattern of FIG. 1A, there are eighteen coil "passes" on a board which is approximately 12″×12″. The board itself should be rigid and of low mass, and capable of withstanding high temperatures. Typical boards which can be employed are Johns-Manville Ceraform and Carborundum Duraboard boards. The materials from which these boards are made can be subjected to temperatures as high as 2,300° F. and the boards themselves are relatively low-priced.

The wire coils themselves are helical coils made of electrical resistance wire such as Nichrome wire made by the Driver-Harris Company of Harrison, New Jersey. The coil is prestretched and preformed to match the groove pattern, as is known in the art. Although the exact dimensions are not critical, the diameter of the coil should be less than the width of the groove, that is, the coil should not make contact with both side walls of the groove. (Preferably, the coil should make contact with neither side wall, but this is almost impossible to achieve. By using grooves which are wider than the diameter of the coil, at most one wall will be contacted at any point along the groove.) After the coils are placed in the grooves, strip terminals 36*a*–36*d* are inserted through holes 16*a*–16*d* and welded to the ends of the coils. The strip terminals extending out of the end of the board can be seen in FIGS. 5 and 7.

As shown in FIG. 2, the grooved surface of the board, with the heating coils in place, is then coated with a layer of cement 22. The layer of cement should be uniform, and approximately 0.02″ thick. The cement should be capable of withstanding high temperatures. As will become apparent, the cement must be capable of flowing downwardly at the beginning of the drying step and, for this reason, if high viscosity cements are used they should first be thinned. In the illustrative embodiment of the invention, the cement which is utilized is Fiberfrax Coating Cement type QF-180 made by the Carborundum Company, Niagara Falls, New York. This cement is first thinned with water which is 7% of the weight of the cement. The cement itself is relatively viscous, but when thus thinned with water it is as free-flowing as ordinary house paint. The thinning has not been found to reduce the strength of the ultimate bond. After the cement is applied to the board, a piece of close-woven fiberglass cloth having a thickness of about 0.05″ is painted on one side with a thin layer (e.g., 0.02″) of the cement. While the surfaces of both the cloth and the board are wet, the wet surface of the cloth is placed on the wet surface of the board. The sandwich is then turned over and placed on a non-stick surface 28 as shown in FIG. 3, the fiberglass cloth itself being shown in this figure by the numeral 26.

Although conventional fiberglass cloths can be used for low-temperature heaters (surface temperatures below 1,000° F.), for higher temperature heaters (surface temperatures up to 1,850° F.) high silica cloth should be employed, e.g., cloth available from Haveg Industries, Inc. of Wilmington, Delaware, or cloth available from the H. I. Thompson Fiber Glass Company (At surface temperatures above 1,850° F., even such cloth will devitrify, resulting in a loss of strength and breakup of the radiating surface with actual melting of the cloth occurring at a temperature of about 3,000° F.)

The inversion of the panel assembly during drying is a key step in the method of my invention and the resulting cement distribution is a key feature of the finished heater. FIG. 4 is an enlarged view of the board, coil, cement and cloth in the vicinity of a groove. The coil itself drops down away from the "bottom" of the groove (which is at the top in the upside-down position) so that almost no contact is made with the bottom of the groove. Although not shown in FIG. 4, it is possible that the coil will contact one of the side walls of the groove. One of the purposes of inverting the panel assembly during the drying step is to insure that the coil adheres to the cement in a position in which minimum contact is made with the groove walls. But more important than what happens to the coil in the upside-down position is what happens to the cement which is initially on the coil (see FIG. 2); it flows down by gravity to mix with the cement on the cloth 26. Almost all of the cement which remains adhered to the coil may be on that half of the coil which is closest to the cloth, but in accordance with the principles of my invention at least 75% of the cement should be so disposed. The following advantages accrue from allowing the cement to dry while placing the board in an upside-down position.

1. In some prior art designs (without board inversion), the cement does not dry in intimate contact with the coil. This is especially true if a deep groove is utilized; if the board is maintained in the position of FIG. 2, the coil sits at the bottom of the groove and especially with a viscous cement relatively little may contact the coil. (In the prior art, the main reason for using the cement is to secure the cloth to the board.) But by inverting the board, the coil drops down and makes intimate contact with the cement, and in some cases even the cloth if the coil drops all the way down. (It should be understood that the drawing of FIG. 4 is not to scale, and the layer of cement 22, if drawn to scale, would be much thinner.) This intimate contact provides for excellent heat transfer by conduction from the coil to the cloth/cement composite which is the ultimate radiating surface, thus increasing the heater efficiency.

2. If the board is maintained in the upright position of FIG. 2 while the cement dries, and if too much cement is used or too thin a cement is used, then in the prior art portions of the groove may fill up completely with cement. In fact, in the prior art it has not always been recognized that excess cement should even be avoided. But as shown in FIG. 4, the coil is secured to the cloth with a minimum of cement. Because there is relatively little cement in contact with the coil, the cloth can heat up rapidly when power is first applied; similarly, it can cool down rapidly when power is turned off. By reducing the mass which is in contact with the coil, temperature changes can take place much more rapidly.

3. Because the coil makes minimum contact with the walls of the groove (in the finished product, the coil makes almost no contact with the bottom wall of the groove and contact with at most one side wall), there is less heat transfer to the board by conduction, thus increasing efficiency.

4. The cement utilized is relatively expensive. Because a minimum amount of cement must be used (and should be used in order to achieve the other advantages of the invention), the cost of the heater is reduced.

5. Because the individual loops of the coil are free to expand due to the clearance between the coil and the groove walls, less stress can develop in the coil when it is heated. This contributes to longer heater life. Furthermore, were the groove completely filled with cement, any expansion of the coil would cause the cloth surface to buckle. This, in turn, would reduce the life of the heater, and possibly its efficiency. But because the groove is not filled with cement as a result of the cement flowing downwardly during the drying step, buckling of the cloth surface does not occur during use of the heater.

Following drying of the cement, the front surface of the fiberglass cloth may be painted black for increasing heater efficiency, a practice which is standard in the industry.

Figure 7:
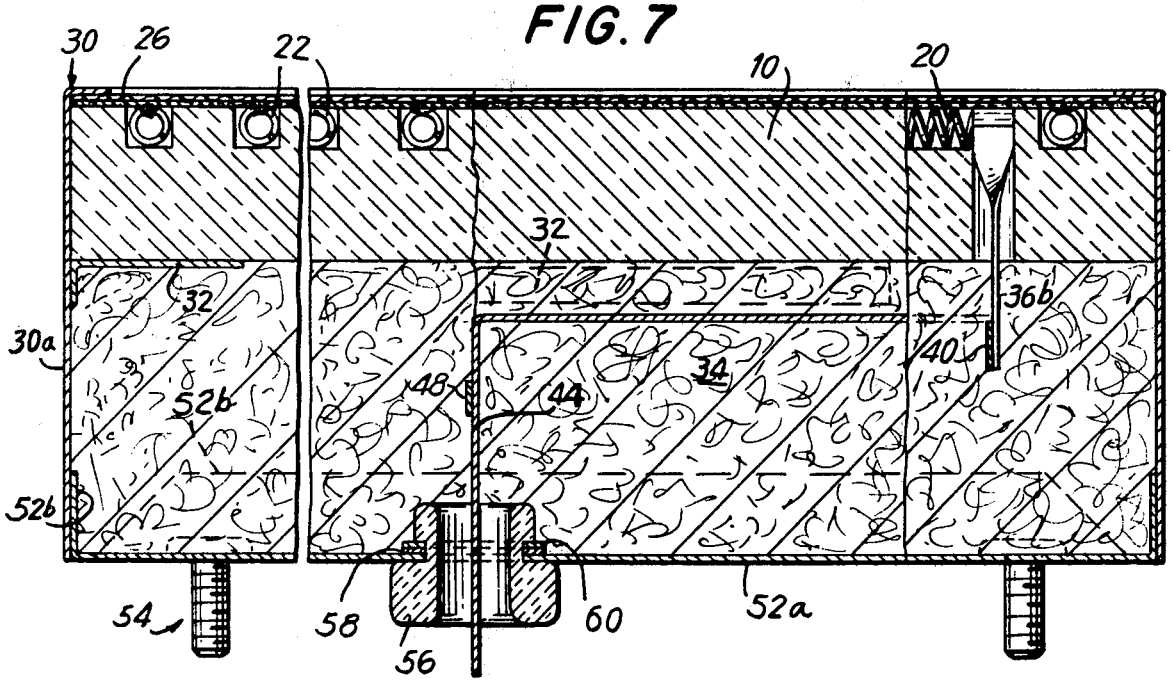
FIG. 7 is a sectional view of the entire heater through the line 7—7 of FIG. 5.

FIGS. 5 and 7 illustrate the manner in which the board is then mounted in housing 30. The front of the housing includes bent-over edges **30*b*, and the housing is placed on a work surface front down. The board assembly is then placed in the housing face down, with the board resting on the bent-over front edges. Brackets 32 are then welded to the housing side walls 30*a* to secure the board in place at the front of the housing. FIG. 5 shows the four terminal strips 36*a*–36*d* extending up through the rear of the insulating board 10. Terminals 36*a* and 36*d* are then connected by welded wire strip 38 to input terminal strip 42, and terminals 36*b* and 36*c* are connected by wire strip 40 to input terminal 44. In this manner, power applied to the two input terminals results in two parallel currents, one flowing in each of the coil sections. The two short strain-relief wire strips 46 and 48 are welded in place and are employed to prevent inadvertent pulling of the input terminals out of the rear cover of the housing. The rear cover is shown in FIGS. 6 and 7, and it includes a pair of conventional electrical grade porcelain bushings 56, each secured in place by standard clips 58 and 60, through which the input terminals 44 and 46 extend. The two wire strips 46 and 48** strike the bushings if the terminals are pulled from the rear of the housing, and thus prevent damage to the heater and perhaps a shorting of the wire strips comprising the electrical connections to the rear cover.

FIGS. 5 and 7 also show additional insulation 34 which is placed in back of the board. This layer of insulation serves to reduce heat loss from the back of the heater, and to force more radiation out of the front surface by increasing the front-surface temperature. In the illustrative embodiment of the invention, insulation 34 is Kaowool ceramic fiber made by the Babcock & Wilcox Company.

The rear cover has a flat surface **52*a* and side edges 52*b*; the latter are inserted within housing 30 as shown in FIG. 7. The rear cover may be secured in place by screws (not shown) extending through the side edges. The rear cover is also provided with four screws 54** for allowing mounting of the heater, only one of several mounting arrangements which may be employed, all of which are standard in the art.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

What I claim is:

1. A method of making a radiant heater panel comprising the steps of forming a groove in one surface of an insulating board, placing a heating coil in said groove, attaching a front radiating material to the grooved surface of said insulating board with a layer of cement, placing the board/material assembly in an upside-down position with the front radiating material being lowermost, and allowing the layer of cement to dry in such position.

2. A method of making a radiant heater panel in accordance with claim 1 wherein the width of said groove relative to the diameter of said heating coil is such that the heating coil fits loosely in the groove.

3. A method of making a radiant heater panel in accordance with claim 2 wherein the cement employed is sufficiently thin such that at the start of the drying step the cement flows downward and at least 75% of the cement which adheres to the coil adheres to that half of the coil which is closest to the front radiating material.

4. A method of making a radiant heater comprising the steps of forming a groove in one surface of an insulating board; placing a heating boil in said groove; attaching terminal means to the ends of said heating coil, said terminal means extending through said insulating board and out of the other surface thereof; attaching a front radiating material to the grooved surface of said insulating board with a layer of cement; placing the board/material assembly in an upside-down position with the front radiating material being lowermost; allowing the layer of cement to dry in such position; and mounting the board/material assembly in a housing with said terminal means extending therethrough.

5. A method of making a radiant heater in accordance with claim 4 wherein the width of said groove relative to the diameter of said heating coil is such that the heating coil fits loosely in the groove.

6. A method of making a radiant heater in accordance with claim 5 wherein the cement employed is sufficiently thin such that at the start of the drying step the cement flows downward and at least 75% of the cement which adheres to the coil adheres to that half of the coil which is closest to the front radiating material.

7. A method of making a radiant heater in accordance with claim 6 wherein said board/material assembly is mounted in said housing at the front thereof and further including the step of placing insulating material in said housing to the rear of said board/material assembly.

8. A method of making a radiant heater in accordance with claim 4 wherein the cement employed is sufficiently thin such that at the start of the drying step the cement flows downward and at least 75% of the cement which adheres to the coil adheres to that half of the coil which is closest to the front radiating material.

9. A method of making a radiant heater in accordance with claim 8 wherein said board/material assembly is mounted in said housing at the front thereof and further including the step of placing insulating material in said housing to the rear of said board/material assembly.

* * * * *